US007411497B2

(12) United States Patent
Kates

(10) Patent No.: US 7,411,497 B2
(45) Date of Patent: Aug. 12, 2008

(54) SYSTEM AND METHOD FOR INTRUDER DETECTION

(76) Inventor: Lawrence Kates, 1111 Bayside Dr., Corona Del Mar, CA (US) 92625

( * ) Notice: Subject to any disclaimer, the term of this patent is extended or adjusted under 35 U.S.C. 154(b) by 97 days.

(21) Appl. No.: 11/464,731

(22) Filed: Aug. 15, 2006

(65) Prior Publication Data

US 2008/0042824 A1 Feb. 21, 2008

(51) Int. Cl.
*G08B 13/18* (2006.01)

(52) U.S. Cl. ..... 340/556; 340/557; 340/573.1; 348/152; 348/155

(58) Field of Classification Search ..... 340/556, 340/557, 572.1, 573.1, 539.1, 522, 5.61, 340/5.81–5.84; 348/152–155; 250/221
See application file for complete search history.

(56) References Cited

U.S. PATENT DOCUMENTS

| | | | | |
|---|---|---|---|---|
| 3,825,916 | A | 7/1974 | Steele et al. | |
| 4,650,990 | A * | 3/1987 | Jonsson | 340/556 |
| 4,862,145 | A | 8/1989 | Meehan et al. | |
| 4,884,064 | A | 11/1989 | Meehan | |
| 4,978,942 | A * | 12/1990 | Bruce | 340/556 |
| 4,998,093 | A * | 3/1991 | Benoit | 340/556 |
| 5,005,416 | A | 4/1991 | Vick et al. | |
| 5,063,288 | A * | 11/1991 | Hsu et al. | 340/557 |
| 5,513,465 | A | 5/1996 | Demarest et al. | |
| 5,575,105 | A | 11/1996 | Otomo | |
| 5,646,404 | A | 7/1997 | Litzkow et al. | |
| 6,028,626 | A | 2/2000 | Aviv | |
| 6,410,872 | B2 | 6/2002 | Campbell et al. | |
| 6,445,301 | B1 | 9/2002 | Farrell et al. | |
| 6,653,971 | B1 | 11/2003 | Guice et al. | |
| 6,720,874 | B2 * | 4/2004 | Fufido et al. | 340/556 |
| 6,724,312 | B1 | 4/2004 | Barber et al. | |

(Continued)

FOREIGN PATENT DOCUMENTS

| | | | |
|---|---|---|---|
| DE | 3230556 | A1 | 3/1984 |

(Continued)

OTHER PUBLICATIONS

Office Action dated Apr. 6, 2007 from Related U.S. Appl. No. 11/086,023.

(Continued)

*Primary Examiner*—Thomas J Mullen, Jr.
(74) *Attorney, Agent, or Firm*—Knobbe, Martens, Olson & Bear, LLP

(57) ABSTRACT

Systems and methods for detecting presence and movement of intruders. Various embodiments of an intruder detection system can be based on, for example, a beam-interrupt detector or a thermal imaging device. The beam-interrupt detection based system can provide functionalities such as counting of intruders crossing a given beam. A plurality of such beams at different heights can also allow distinguishing different-sized intruders. The thermal imaging based detection system can provide functionalities such as tracking movement of intruders. A recording can be triggered by detection of intruder movement, thereby improving the efficiency of recording and reviewing information indicative of presence and movement of intruders in a monitored area. In one embodiment, non-intruders can be distinguished from intruders by querying an RFID tag carried by non-intruders. In one embodiment, non-intruders can be distinguished from intruders by facial recognition.

44 Claims, 14 Drawing Sheets

U.S. PATENT DOCUMENTS

| | | | | |
|---|---|---|---|---|
| 6,853,328 | B1 | 2/2005 | Guice et al. | |
| 6,937,156 | B2 | 8/2005 | Gardner et al. | |
| 7,071,829 | B2 | 7/2006 | Gardner et al. | |
| 7,239,720 | B2 | 7/2007 | Shima | |
| 7,286,056 | B2 | 10/2007 | Kates | |
| 2002/0062205 | A1 | 5/2002 | Roberts | |
| 2002/0067259 | A1 | 6/2002 | Fufidio et al. | |
| 2004/0200129 | A1 | 10/2004 | Studer et al. | |
| 2005/0145786 | A1 | 7/2005 | Rice et al. | |
| 2005/0162515 | A1 | 7/2005 | Venetianer et al. | |
| 2005/0249384 | A1 | 11/2005 | Fouquet et al. | |
| 2006/0028345 | A1 | 2/2006 | Lee | |
| 2006/0215885 | A1 | 9/2006 | Kates | |
| 2006/0225352 | A1* | 10/2006 | Fischer et al. | 49/49 |
| 2007/0075860 | A1* | 4/2007 | Tracy | 340/556 |
| 2008/0069401 | A1 | 3/2008 | Kates | |

FOREIGN PATENT DOCUMENTS

| | | | |
|---|---|---|---|
| DE | 102004038906 | A1 | 3/2006 |
| ES | 2255886 | A1 | 3/2006 |
| GB | 2350221 | A | 11/2000 |
| JP | 09094048 | A | 4/1997 |
| JP | 2000253799 | A | 1/2001 |
| WO | WO 82/00377 | A1 | 2/1982 |
| WO | WO 02/23498 | A1 | 3/2002 |
| WO | WO 03-084319 | A1 | 10/2003 |
| WO | WO 2004/051590 | A2 | 6/2004 |
| WO | WO 2004/051590 | A3 | 6/2004 |
| WO | WO 2004/068432 | A1 | 8/2004 |

OTHER PUBLICATIONS

Office Action dated Aug. 14, 2007 from Related U.S. Appl. No. 11/086,023.

Notice of Allowance dated Sep. 6, 2007 from Related U.S. Appl. No. 11/086,023.

Office Action dated Apr. 3, 2008 from Related U.S. Appl. No. 11/876,523.

* cited by examiner

SYSTEM AND METHOD FOR INTRUDER DETECTION

BACKGROUND

1. Field

The present teachings generally relate to the intruder control and more particularly, to systems and methods for detecting and monitoring intruders.

2. Description of the Related Art

Presence of intruders in a home, office, or other occupied areas can be difficult to ascertain, especially when authorized people (e.g., homeowners, children, etc.) and/or pets are in the area. Typical burglar alarm systems attempt to monitor points of entry into a building (e.g., doors, windows, etc.). If an intruder is able to gain access to the building without activating the point of entry monitor, then the intruder may go undetected. Some burglar alarm systems try to overcome the weaknesses of point-of-entry monitors by using motion detectors. However, such motion detectors are generally not used when people are present, or are used in un-occupied areas (e.g., non-sleeping areas) during nighttime. However, motion detectors can trigger false alarms due to motion of pets, air currents, etc. Thus, there is a need for an improved intruder detection system that can distinguish between intruders and non-intruders.

SUMMARY

The foregoing needs are addressed by systems and methods for detecting the presence and movement of intruders. Various embodiments of an intruder detection system can be based on, for example, a video monitoring system, beam-interrupt detector, beam backscatter detector, and/or a thermal imaging device. In one embodiment, a recognition system is used to distinguish between intruders and non-intruders. The beam-interrupt detection based system can provide functionalities such as counting of intruders crossing a given beam. A plurality of such beams at different heights can also allow distinguishing different sized intruders (e.g., pets, children, adults, etc.). An imaging-based detection system can provide functionalities such as tracking the movement of intruders and/or distinguishing intruders from non-intruders. A recording can be triggered by detection of intruder movement, thereby improving the efficiency of recording and reviewing information indicative of presence and movement of intruders in a monitored area. Imaging can be based on visual light, infrared (active and/or passive), ultraviolet light, and/or radar imaging.

In one embodiment, the intruder detection system includes a transmitter configured to produce an energy beam, a first receiver configured to detect energy from the beam, and a processor provided to the first receiver. The processor is configured to detect a presence of intruders by determining when the energy beam is at least partially interrupted. In one embodiment, the processor is also configured to distinguish between intruders and non-intruders.

In one embodiment, the first receiver is aligned with the beam. In one embodiment, the first receiver is configured to receive backscattered energy from the beam when the beam illuminates an intruder. In one embodiment, the first receiver is configured to receive bistatic backscattered energy from the beam when the beam illuminates an intruder. In one embodiment, the first receiver is battery-powered. In one embodiment, the first transmitter is battery-powered. In one embodiment, the processor is configured to control the first transmitter. In one embodiment, the processor is configured to control the first transmitter by using wireless communication. In one embodiment, the processor is configured to receive data from the first receiver by using wireless communication.

In one embodiment, the first receiver is provided at a first height, the system further comprising a second receiver provided at a second height.

In one embodiment, the first transmitter comprises a laser. In one embodiment, the first transmitter produces the energy beam as a substantially continuous beam. In one embodiment, the first transmitter produces the energy beam as an intermittent beam. In one embodiment, the first transmitter produces the energy beam as a pulsed beam. In one embodiment, the first transmitter produces the energy beam as a substantially continuous beam.

In one embodiment, the system is configured to produce the energy beam at night. In one embodiment, the intruder detection system includes a light sensor, and the system is configured to produce the energy beam during periods of relative darkness. In one embodiment, the system is configured to produce the energy beam during one or more specified time periods. In one embodiment, the intruder detection system includes a motion detector configured to detect motion from humans, and wherein the system is configured to produce the energy beam during periods when motion is not detected. In one embodiment, the system is configured to turn off the energy beam when a room light turns on. In one embodiment, the system is configured to turn off the energy beam when motion is detected by a motion detector. In one embodiment, the receiver is configured to send data at regular intervals. In one embodiment, the receiver is configured to send data when a specified intruder detection count is exceeded. In one embodiment, the receiver is configured to send data when at least a partial interruption of the beam is detected.

In one embodiment, the receiver is configured to send data when a backscatter from the beam changes. In one embodiment, the receiver is configured to send data when interrogated by the processor.

In one embodiment, the intruder detection system includes a camera configured to produce first and second digital images, and a processor provided to the camera. The processor is configured to examine the first and second digital images to detect a movement of one or more intruders by determining movement of an intruder-sized object in the first and second images.

In one embodiment, the camera is configured to produce an image from infrared light corresponding to thermal sources.

In one embodiment, the intruder detection system includes an illumination source configured to at least partially illuminate a field of view of the camera. In one embodiment, the illumination source comprises an infrared source. In one embodiment, the illumination source comprises an ultraviolet source.

In one embodiment, the camera comprises a zoom feature controlled by the processor. In one embodiment, the camera comprises a pan feature controlled by the processor. In one embodiment, the processor is configured to control the camera by using wireless communication.

In one embodiment, an imaging device (e.g., a digital camera) is configured to identify the one or more intruders at least in part by measuring a size of the intruder in the first image. In one embodiment, the camera is configured to identify the one or more intruders, at least in part, by measuring a size and movement track of the intruder in the first and second images. In one embodiment, the processor is configured to distinguish between intruders and humans, at least in part, by measuring a size of a moving object in the first and second image. In one embodiment, intruders are distinguished from non-intruders by identification techniques, such as, for example, facial recognition, gait recognition, etc. In one embodiment, intruders are distinguished from non-intruders using, at least in part, RFID tags carried by non-intruders. In one embodiment, when the imaging device detects an object likely to be human (e.g., adult, child, etc.) the system is configured to activate an RFID reader to interrogate RFID tags in the region where the imaging device has detected the object. If the object is not carrying a valid RFID tag, then the system can send an alarm or alert indicating that an intruder has been detected. In one embodiment, if a non-intruder is detected, then the imaging system does not record images. In one embodiment, if an intruder is detected, then the imaging system records and, optionally, transmits images of the intruder.

In one embodiment, the system distinguishes between adults, children, pets, and, optionally, rodents. In one embodiment, the system reports the presence of rodents, pets in unauthorized areas (e.g., children or pets in unauthorized areas, pets on the furniture, etc.).

In one embodiment, the system is configured to operate at night. In one embodiment, further comprising a light sensor, and wherein the system is configured to operate during periods of relative darkness. In one embodiment, the system is configured to operate during one or more specified time periods. In one embodiment, the intruder detection system includes a motion detector configured to detect motion, and wherein the system is configured to operate imaging or beam detection equipment during periods when motion is detected. In one embodiment, the system is configured to suspend intruder detection when a room light turns on. In one embodiment, the system is configured to suspend intruder detection when motion is not detected by a motion detector.

In one embodiment, the camera is configured to send data at regular intervals. In one embodiment, the camera is configured to send data when a specified intruder detection count is exceeded. In one embodiment, the camera is configured to send data when at least a partial interruption of the beam is detected. In one embodiment, the camera is configured to send data when a backscatter from the beam changes. In one embodiment, the camera is configured to send data when interrogated by the processor.

DETAILED DESCRIPTION OF SOME EMBODIMENTS

Figure 1:
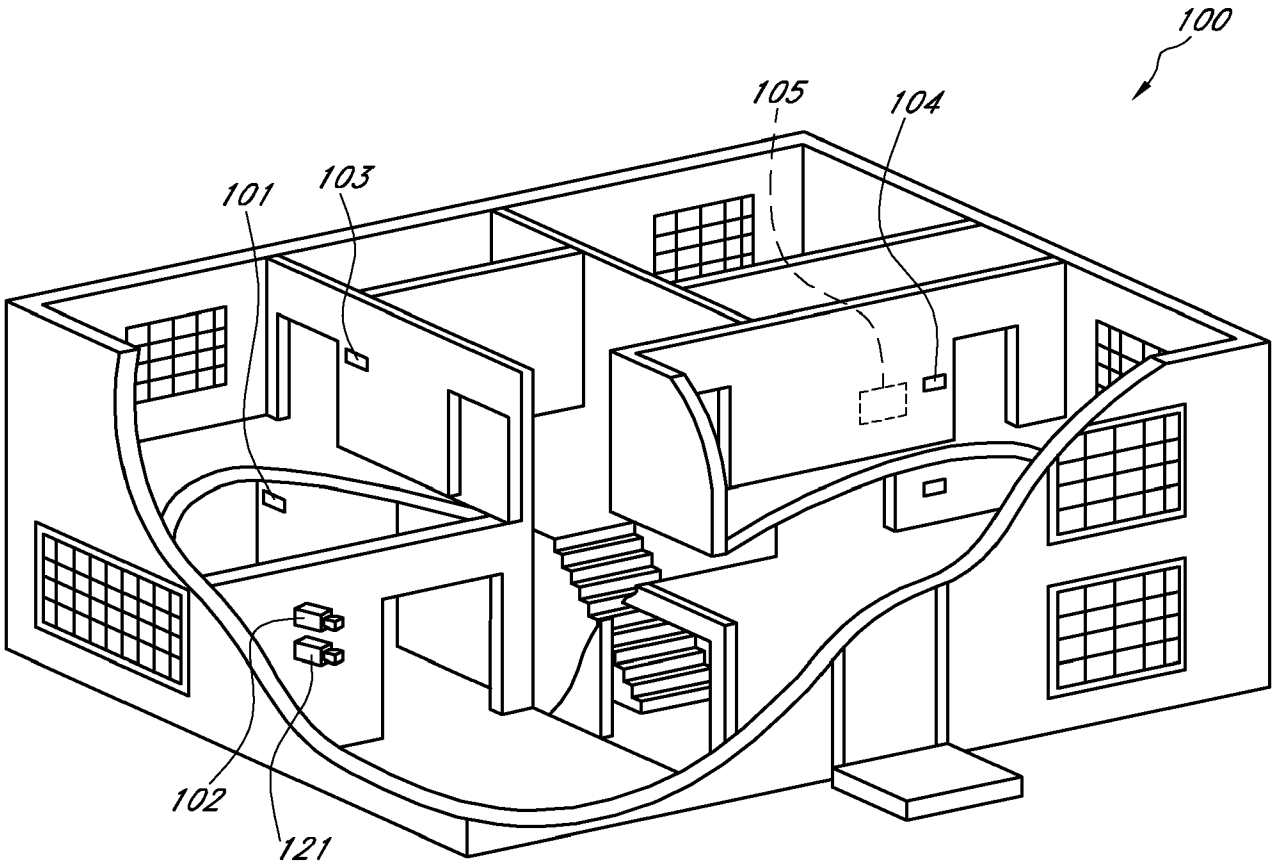
FIG. 1 shows a building protected by an intruder detection system having a first sensor and an RFID reader configured to allow detection of intruders.

The present teachings relate to systems and methods for detecting and/or tracking intruders. FIG. 1 shows a building protected by an intruder detection system 100 that includes on one or more image sensors such as an image sensor 102 and one or more RFID readers such as an RFID reader 121. The system 100 also includes one or more motion optional motion detectors 101, one or more optional beam detectors 103, and a control panel 104. The sensor 102, reader 121, detectors 101, 103, and the control panel 104 are provided to a processor. In one embodiment, the control panel 104 includes an optional thumbprint (or fingerprint) reader.

In general, it will be appreciated that the processor can include, by way of example, computers, program logic, or other substrate configurations representing data and instructions, which operate as described herein. In other embodiments, the processors can include controller circuitry, processor circuitry, processors, general purpose single-chip or multi-chip microprocessors, digital signal processors, embedded microprocessors, microcontrollers and the like.

Furthermore, it will be appreciated that in one embodiment, the program logic can be implemented as one or more components. The components can be configured to execute on one or more processors. The components include, but are not limited to, software or hardware components, modules such as software modules, object-oriented software components, class components and task components, processes methods, functions, attributes, procedures, subroutines, segments of program code, drivers, firmware, microcode, circuitry, data, databases, data structures, tables, arrays, and variables.

Figure 2:
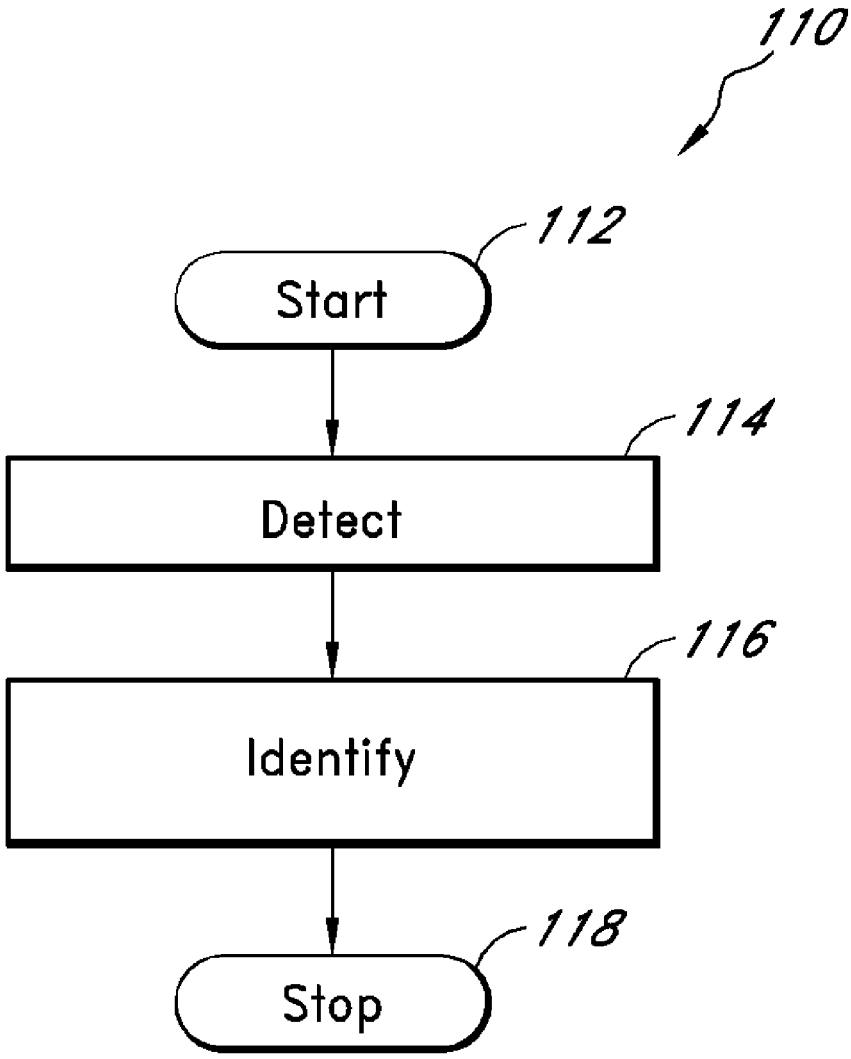
FIG. 2 shows one embodiment of a process that can be performed by the processor of the intruder detection system of FIG. 1.

FIG. 2 shows one embodiment of a process 110 that can be performed by the system 100 of FIG. 1. The process 110 begins at a start state 112, and in a process block 114, the process 110 performs an intruder detection function. In a process block 116, the process 110 performs one or more post-detection functions. The process 110 ends at a stop state 118. Various examples of the intruder detection and post-detection functionalities of the foregoing process blocks are described below in greater detail.

Figure 3A:
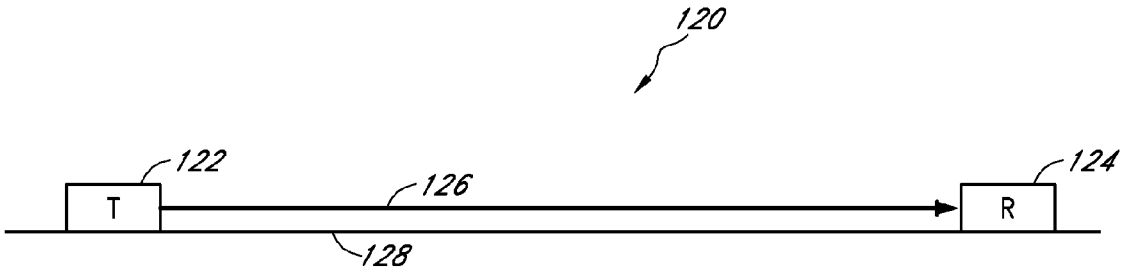
FIGS. 3A and 3B show one embodiment of an example detector assembly that can be configured to provide intruder detection function of the sensor of the system of FIG. 1.
Figure 3B:
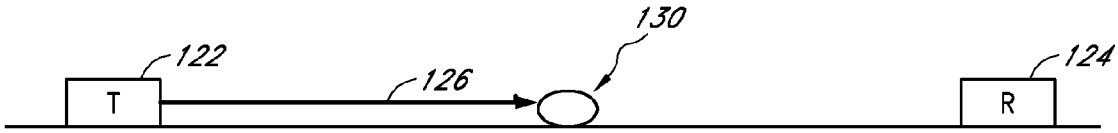

FIGS. 3A and 3B show an example operation of one embodiment of a sensor assembly 129 that can be an example of the sensor component 102 described above in reference to FIG. 1. As shown in FIG. 3A, the sensor assembly 129 includes a transmitter 122 and a receiver 124 positioned on an example surface 128. In one embodiment, the transmitter 122 transmits a "beam" 126 of electromagnetic radiation that is detectable by the receiver 124 when the beam 126 is substantially unobstructed. For the purpose of description herein, "beam" can include highly coherent and directional radiation such as a laser, to other types of more dispersive radiation that are collimated or shaped sufficiently to allow detection by the receiver 124 when substantially unobstructed.

FIG. 3B shows that an intruder 130 between the transmitter 122 and the receiver 124 can break or partially obstruct the beam 126 so that the receiver 124 detects a drop in beam intensity of the beam 126 due to a full or partial interruption of the beam 126. Thus, the sensor assembly 129 can be used to detect the presence of one or more intruders in a region between the transmitter 122 and the receiver 124. The separation distance between the transmitter 122 and the receiver 124 can be determined by factors such as, but not limited to, how well the beam 126 is defined, the dimension of an area to be monitored, the likely density of the intruders crossing the beam 126, and the desired objective of detection. For example, if the desired objective is to monitor a large area, and the intruder density is not an important concern, one can separate the transmitter and the receiver relatively far apart and use a relatively highly defined beam such as a laser. In another example, if the desired objective is to obtain a more accurate count of intruders passing through a given monitored area, the separation between the transmitter and the receiver can be reduced to thereby reduce the likelihood that the beam will be broken by more than one intruder at a given time.

Figure 3C:
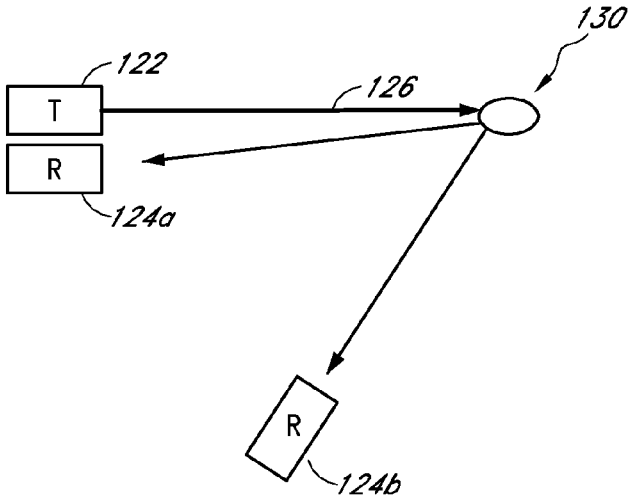
FIG. 3C shows one embodiment of an example bistatic and/or monostatic backscatter detector assembly that can be configured to provide intruder detection function of the sensor of the system of FIG. 1.

The transmitter 122 and receiver 124 can also be arranged to detect backscatter of the beam 126 as monostatic and/or bistatic scattering of the beam 126. FIG. 3C shows one embodiment of an example of a detector assembly wherein a detector 124*a* is positioned to receive monostatic scattering of the beam 126 from the intruder 130, and a detector 124*b* is positioned to receive bistatic scattering of the beam 126 from the intruder 130.

In a backscatter arrangement, the transmitter 122 and receiver 124 can be placed in relative proximity to one another such that reflections of the beam by an intruder are detected by the receiver 124. In one embodiment, the system 100 establishes a background threshold backscatter level corresponding to reflection sources in the room. When an intruder moves through the beam, the backscatter level will typically change and thus the system 100 can record the presence of an intruder. The backscatter system has an advantage in that backscatter tends to occur over relatively large angular regions. Thus, alignment of the transmitter 122 and receiver 124 so that the beam 126 travels from the transmitter 122 to the receiver 124 is relatively easier than in the case of a beam-interrupt system. In a beam interrupt system, the transmitter 122 and receiver 124 typically must be aligned so that the beam emitted by the transmitter 122 is received by the receiver 124.

The sensor assembly 120 can also be configured to provide different heights of the beam 126 relative to the example surface 128. Different heights of one or more beams can be used to allow the intruder detection system to distinguish different sized creatures that can be present in the monitored area. An example of such discrimination of different sized creatures is shown in FIG. 4.

Figure 4:
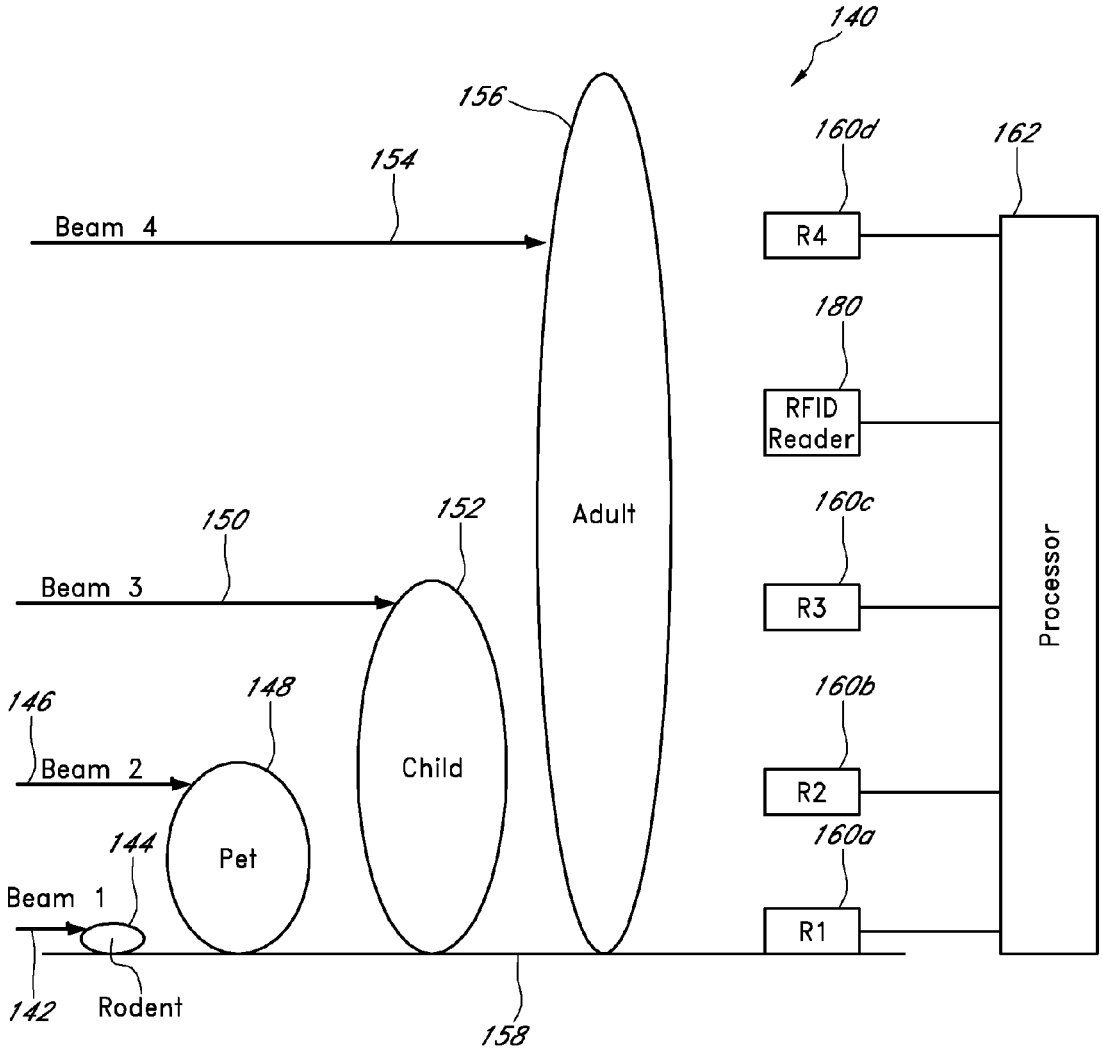
FIG. 4 shows one example embodiment of the detector assembly having a plurality of detectors that can be positioned at different heights and be configured to distinguish different types of detected objects.

In one embodiment of an example detection system 140 as shown in FIG. 4, a plurality of sensor assemblies are positioned at different selected heights. For example, a first beam 142 is at a first height relative to an example floor surface 158; a second beam 146 is at a second height that is greater than the first height; a third beam 150 is at a third height that is greater than the second height; and a fourth beam 154 is at a fourth height that is greater than the third height. Four example corresponding receivers, 160*a*, 160*b*, 160*c*, and 160*d* are positioned relative to the surface 158 so as to detect their respective uninterrupted beams 142, 146, 150, and 154, and not detect their respective broken beams (or other uninterrupted beams).

The four example receivers 160 are functionally linked to a processor 162 that can determine what type of creature is likely causing one or more of the beams to be broken. Four example creatures are depicted for the purpose of description—a rodent 144, a pet 148, a child 152, and an adult 156. For the purpose of description, it will be assumed that the foregoing example creatures have increasing heights as listed. For example, the adult 156 is taller than the child 152. In one embodiment, an optional RFID reader 180 is provided to read RFID tags carried by non-intruder adults, children, and/or pets.

As shown in FIG. 4, one or more beams can be positioned at different heights so that the example adult 156 is able to break all four beams 142, 146, 150, and 154. The example child 152 is able to break the three lower beams 142, 146, and 150, but not the highest beam 154. The example pet 148 is able to break the two lower beams 142 and 146, but not the two highest beams 152 and 156. The example rodent 144 is able to break the lowest beam 142, but not the three higher beams 146, 150, and 154. Based on such configuration of the example beam heights, one can see that the processor 162 can be configured to distinguish the foregoing four example creatures. Thus, it will be understood that the intruder detection system of the present teachings can be configured to distinguish and/or identify different types of creatures based at least on their sizes, thereby improving the manner in which intruders can be detected.

When one of the sensors 160 detects movement (e.g., when the sensor 160 detects that the corresponding beam has been broken in a transmission-type system, or the sensor 160 detects backscatter in a backscatter-type system) then the processor 162 can use the RFID reader 180 to search for a valid RFID tag. If a valid RFID tag is detected, then the processor 162 concludes that the movement was caused by a non-intruder. If a valid RFID tag is not detected, then the processor 162 concludes that the movement was due to an intruder and takes appropriate action.

The appropriate action can depend on the type of intruder detected. If the sensor 160*a* detects movement corresponding to the beam 142, then the processor 162 concludes that the intruder is a rodent or other small creature and reports the possible infestation. If the sensor 160*b* detects movement corresponding to the beam 146, then the processor 162 concludes that the intruder is a pet without an RFID tag (or a pet in an unauthorized area) and reports the matter.

If the sensor 160*d* detects movement corresponding to the beam 154, then the processor 162 concludes that the intruder is an adult. In one embodiment, upon detecting an adult intruder, the processor 162 activates a warning indicator (e.g., light indicator and/or sound indicator) and gives the adult intruder a relatively short period of time in which to enter an authorization code (e.g., using the control panel 104). The authorization code can be a code typed into a keypad on the control panel 104 or, if a thumbprint reader is provided to the control panel, a thumbprint or other fingerprint. If no authorization code is entered within the specified time period, then the processor 162 can sound an alarm, contact a security service, etc.

Figure 9:
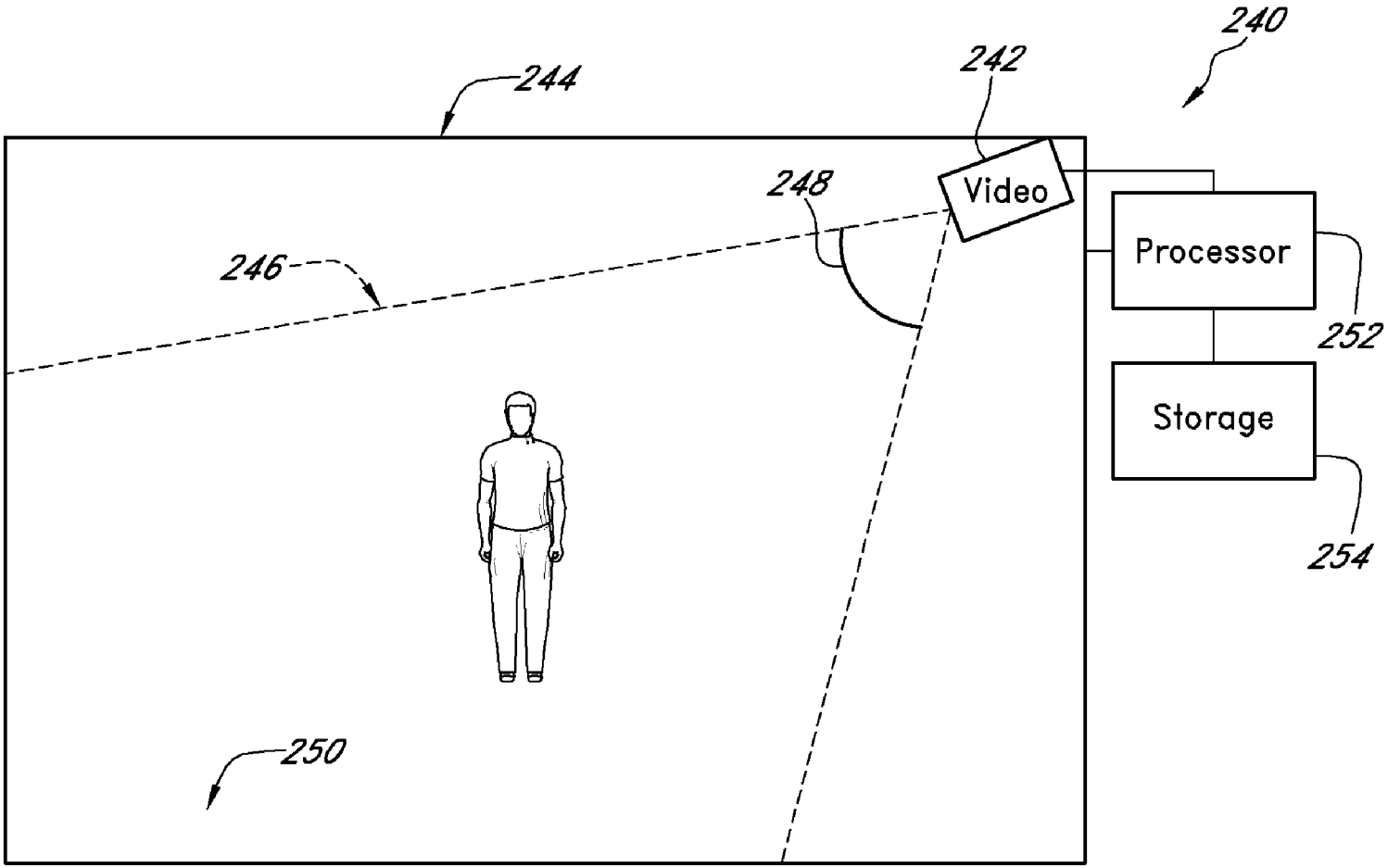
FIG. 9 shows one embodiment of an intruder detector system that is based on imaging of a monitored area.
Figure 10:
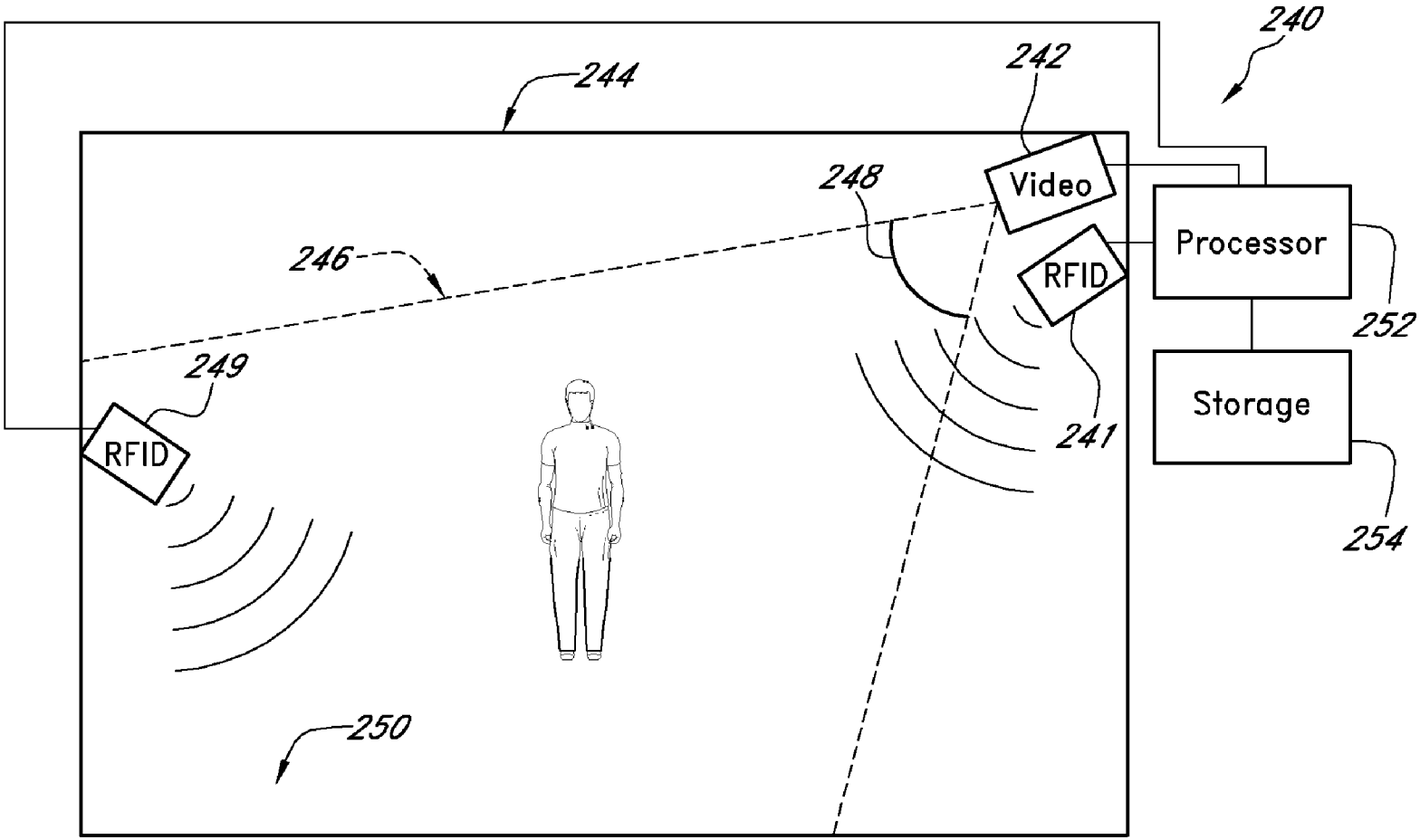
FIG. 10 shows one embodiment of an intruder detector system that is based on imaging of a monitored area and using one or more RFID readers to distinguish between intruders and non-intruders.

In one embodiment, the beam-based system 140 shown in FIG. 4 is used as a motion detector in connection with an imaging-based system such as shown in FIG. 9 or 10. When the system 140 detects motion due to a suspected intruder, the system 140 can activate the imaging system of FIGS. 9 and/or 10 to provide further data for identification and/or to record images of the intruder.

In one embodiment, the beam-based system 140 is used in hallways, stairways, doorways, and/or other points of ingress or egress, and the imaging based systems shown in FIGS. 9 and/or 10 are used to cover areas such as, for example, rooms, entryways, etc. One of ordinary skill in the art will recognize that the beam-based system of FIG. 4 and the imaging based systems of FIGS. 9 and 10 can also be used together to cover the same areas to provide additional security and reliability.

While a conventional home security-type motion detector typically does not provide enough information to distinguish between intruders and non-intruders, a conventional motion detector can be used in connection with the systems of FIGS. 4, 9 and 10. In one embodiment, a conventional motion detector is used to provide an initial detection of motion, and when such motion is detected, then the beam-type motion detector 140 and/or the imaging detectors shown in FIGS. 9 and/or 10 can be activated to provide additional detail and analysis of the cause of the motion.

Figure 5:
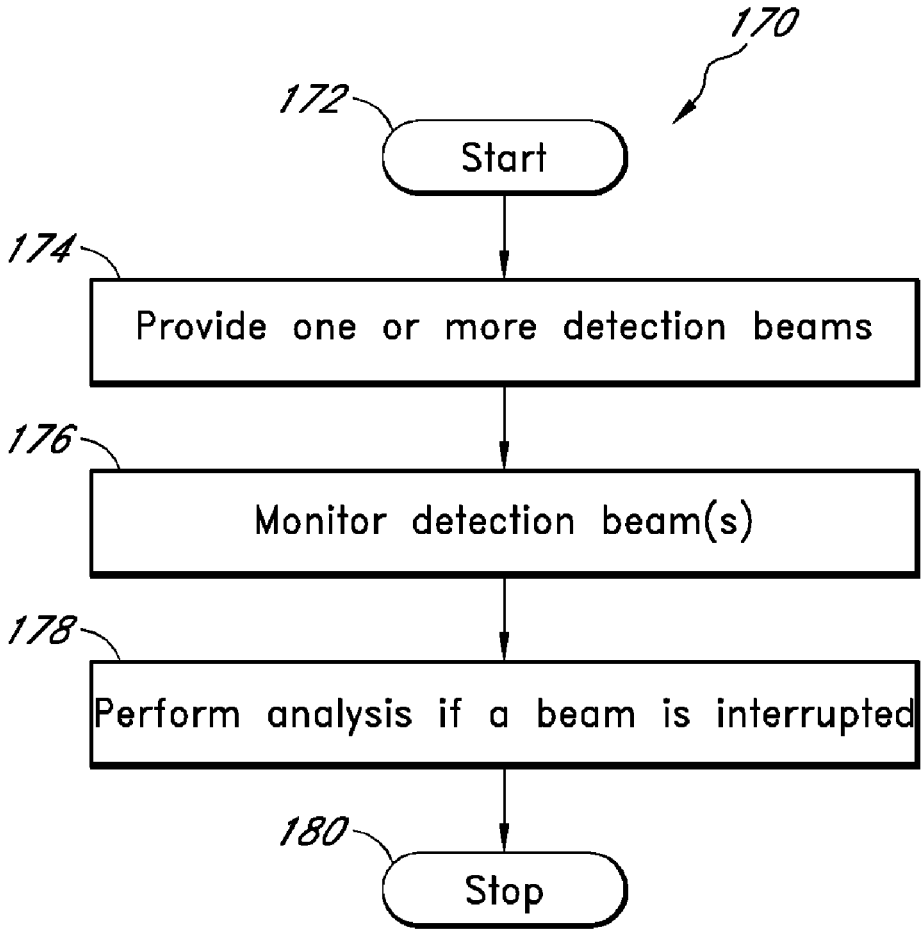
FIG. 5 shows one embodiment of an example process that can be performed in conjunction with the example detector assembly of FIG. 4.

FIG. 5 now shows one embodiment of a process 170 that can achieve the foregoing function of detecting and distinguishing intruders from other types of creatures. The process begins at a start state 172, and in a process block 174, the process 170 provides one or more detection beams. In one embodiment, the one or more detection beams are positioned at different heights relative to a given surface such as a floor. In a process block 176, the process 170 monitors the one or more detection beams. In a process block 178, the process 170 performs an analysis if one or more of the detection beams are interrupted.

Figure 6:
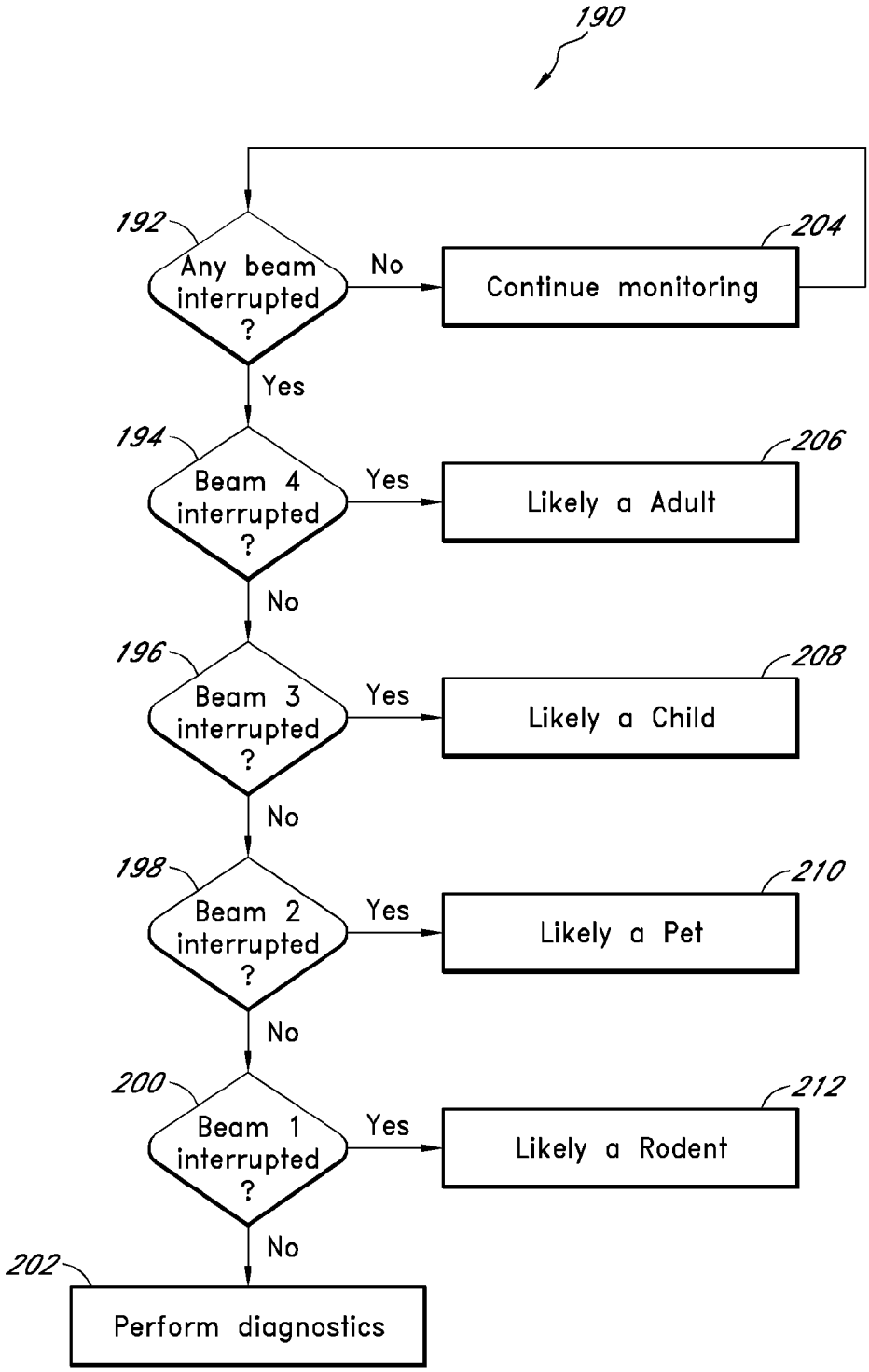
FIG. 6 shows an example process that can perform a portion of the process of FIG. 5 so as to allow differentiation of the example detected creatures.

FIG. 6 shows one embodiment of a process 190 that can be an example of a portion of the process 170 described above in reference to FIG. 5. In particular, the process 190 is described in the context of the example detection system 140 described above in reference to FIG. 4, and can be performed during some combination of the process blocks 176 and 178 of the process 170 of FIG. 5. It will be understood that the process 190 and the detection system 140 are examples for the purpose of description, and in no way are intended to limit the scope of the present teachings.

As shown in FIG. 6, the process 190 in a decision block 192 determines whether any beam has been interrupted. If the answer is "No," then the process 190 in a process block 204 continues the beam monitoring function. In one embodiment, the process 190 loops back to the decision block 192 after a predetermined time. If the answer in the decision block 192 is "Yes," the process 190 proceeds to determine which of the beam(s) has(have) been interrupted.

In a decision block 194, the process 190 determines whether the fourth beam has been interrupted. If the answer is "Yes," then the process 190 in a process block 206 determines that the detected creature is likely an adult. If the answer is "No," then the process 190 determines that the detected creature is likely not an adult, and continues to a decision block 196.

In the decision block 196, the process 190 determines whether the third beam has been interrupted. If the answer is "Yes," then the process 190 in a process block 208 determines that the detected creature is likely a child. If the answer is "No," then the process 190 continues to a decision block 198.

In the decision block 198, the process 190 determines whether the second beam has been interrupted. If the answer is "Yes," then the process 190 in a process block 210 determines that the detected creature is likely a pet such as a dog or cat. If the answer is "No," then the process 190 continues to a decision block 200.

In the decision block 200, the process 190 determines whether the first beam has been interrupted. If the answer is "Yes," then the process 190 in a process block 212 determines that the detected creature is likely a rodent. If the answer is "No," then the process 190 determines that the detected creature is likely not any of the creatures that it is programmed to identify, and proceeds to a process block 202 where a diagnostic function can be performed.

It will be understood that the example process 190 described above in reference to FIG. 6 is an example of how the four example beams can be used to distinguish various sized creatures. It will be understood that within such an example, there are numerous ways of implementing the distinguishing logic, and the example logic of the process 190 is just one example.

Figure 7:
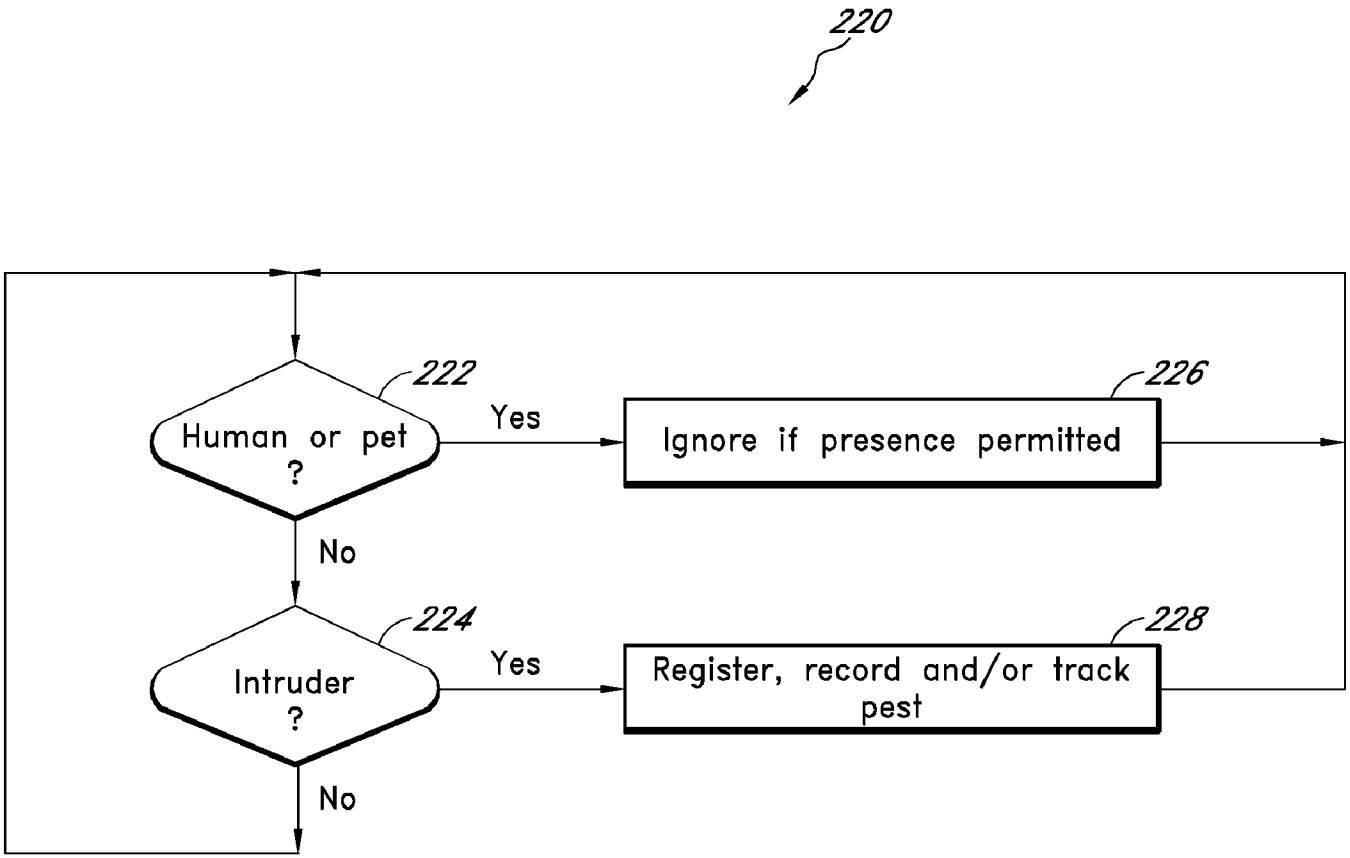
FIG. 7 shows an example process that can perform a portion of the process of FIG. 5 so as to determine what actions can be taken with respect to the detected and differentiated creatures.

FIG. 7 now shows another example process 220 that can process the identified creature information obtained from the example process 190 of FIG. 6. In one embodiment, the process 220 can be configured to ignore the presence of non-intruders under certain condition(s), and perform additional function(s) for intruders. Thus, as shown in FIG. 7, the example process 220 in a decision block 222 determines whether the detected creature is a non-intruder (e.g., an occupant adult or child, guest, etc.) or pet. If the answer is "Yes," then the process in a process block 226 ignores the human or pet if it determines that the detected presence is permitted. Pets are generally permitted. However, certain areas are restricted, and pets are not supposed to be in such areas (e.g., a living room, etc.) then the system can signal an alert or record a report for later review. For humans, the system distinguishes between non-intruders and intruders by using an identification system. In one embodiment, identification is based on facial recognition. In one embodiment, identification is based on other recognition techniques (e.g., gait recognition, fingerprint readers, etc.). In one embodiment, identification is based on badge recognition. In one embodiment, identification is based on querying an RFID tag. In such an embodiment, when the system detects a human (e.g., adult or, optionally, a child), the system activates an RFID reader that reads RFID tags in the location of the detected human. If a valid RFID tag is found, then the system concludes that the human is not an intruder. If no valid RFID tag is found, then the system concludes that an intruder may be present. In one embodiment, when an intruder is detected, the system signals an alert (e.g., a flashing light and/or audio alert) to give the human a relatively short period of time to enter an access code. Thus, for example, if an occupant gets out of bed at night and forgets to carry an RFID tag, the system, upon detecting the un-tagged occupant, will give the occupant a warning and a short period of time in which to enter an access code. If an intruder is detected and no access code is subsequently entered, then the system reports an alarm condition (e.g., loud alert, notification of security service, etc.)

In one embodiment, intruders are distinguished from non-intruders using a combination of identification techniques, such as, for example, facial recognition, gait recognition, reading of RFID tags, etc.

If the answer is "No," the process 220 proceeds to a decision block 224, where it determines whether the detected object is an intruder (e.g., a human intruder, a pest such as a rodent). If the answer is "Yes," the process 220 in a process block 228 performs some combination of functions that registers, records, and tracks the intruder. Some examples of these functions are described below in greater detail. In one embodiment, as shown in FIG. 7, the example process 220 can perform a substantially repeating function for analyzing subsequent detections, so that it loops back to the decision block 222 from the process blocks 226 and 228, and also from the "No" result of the decision block 224.

Figure 8:
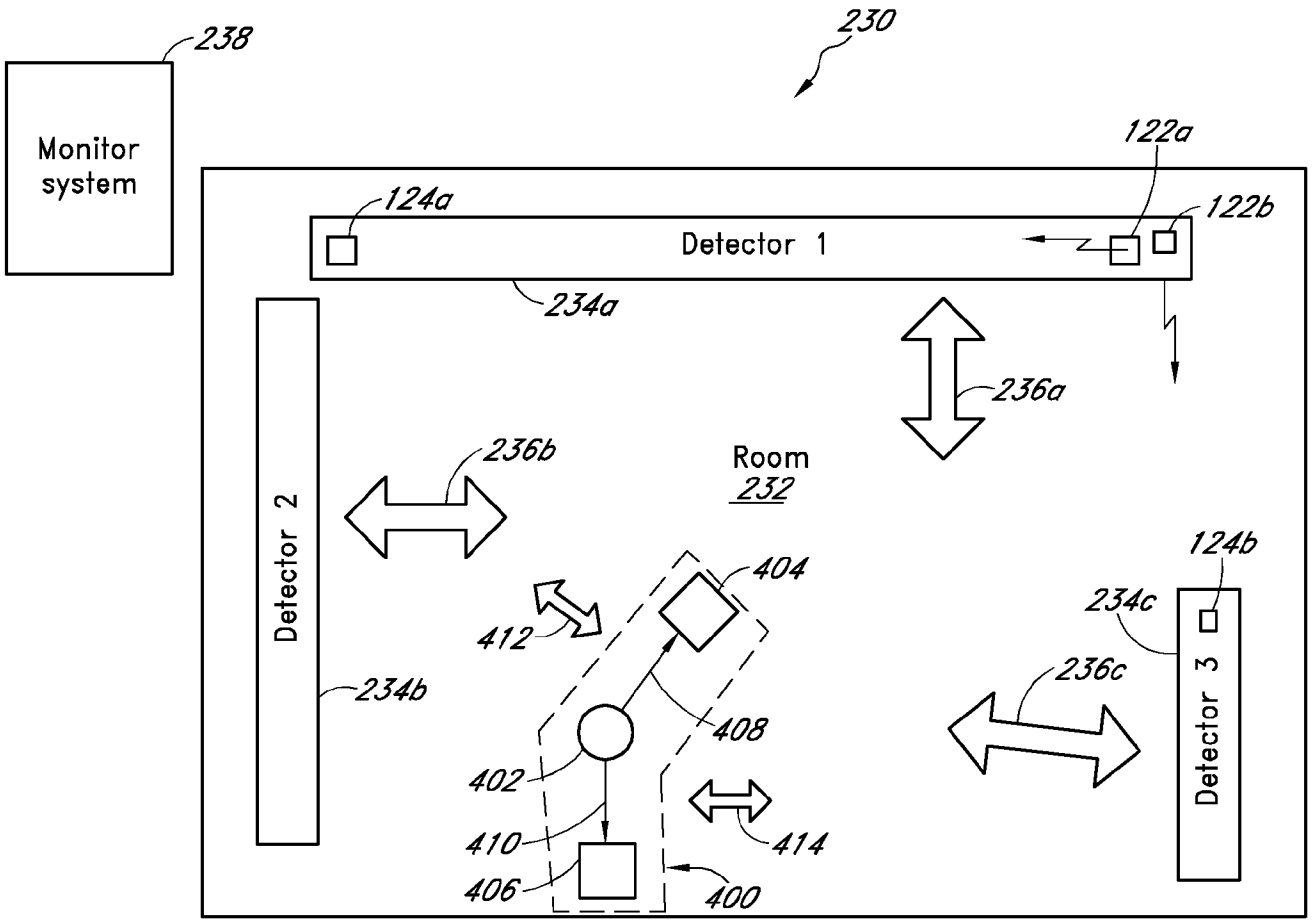
FIG. 8 shows one embodiment of an example detector arrangement in a monitored area, showing that one or more detectors can be arranged in numerous orientations to detect intruder movements at different parts of the monitored area.

FIG. 8 shows, by example, how the beam-interrupt based detection system described above can be arranged within a given area to register and track the movements of intruders. One embodiment of a detection system 230 can include a plurality of detectors positioned at different locations within a given area such a room 232. For example, an example first detector 234*a* (having a transmitter 122*a* and the receiver 124*a*) is shown to provide a relatively wide coverage along a long wall so as to permit detection of intruder movements to and from the long wall, as indicated by an arrow 236*a*. A similar example second detector 234*b* can provide coverage for one of the other walls, so as to permit detection of intruder movements to and from that wall, as indicated by an arrow 236*b*. A third example detector 234*c* (using a transmitter 122*b* and the receiver 124*b*) is shown to be positioned about a corner of the example room 232; such a detector can be used to detect intruder movements to and from a location about that corner, as indicated by an arrow 236*c*.

As further shown in FIG. 8, an example detector 400 can also include a transmitter assembly 402 that transmits one or more beams (for example, first and second beams 408 and 410) to different directions. The first beam 408 is shown to be detectable by a first receiver 404 so as to provide information about intruder movements along the area between the transmitter assembly 402 and the first receiver (as indicated by an arrow 412). The second beam 410 is shown to be detectable by a second receiver 406 so as to provide information about intruder movements along the area between the transmitter assembly 402 and the second receiver 406. The transmitter assembly 402 and the corresponding receivers 404, 406 can be configured in numerous ways to allow flexibility in how and where intruder movements can be detected.

In one embodiment, the detection beams, such as those from the transmitter assembly 402, and the corresponding receivers can be passive devices. In one embodiment, the transmitters can provide beams on a substantially continuous basis. In one embodiment, the transmitters can provide beams on an intermittent basis. Transmitters can be scanned or moved to different locations in a flexible manner. In such an embodiment, information about detection can be obtained from the corresponding receivers.

In one embodiment as shown in FIG. 8, detection information from the detectors (and in one embodiment, from the receivers alone) can be transferred to a processing component such as a monitoring system 238. In one embodiment, the monitoring system 238 can be configured to count the number of times a given detection beam is interrupted. Accumulation of such counts for a given period can indicate an estimate of the location and path of intruder movements for the covered area corresponding to that detection beam.

In one embodiment, the monitoring system 238 includes a light sensor and is configured to operate the intruder detection system when the room is dark. In one embodiment, the monitoring system 238 is configured to operate the intruder detection system according to a specified time of day (e.g., during the nighttime hours) and/or when activated by an occupant (e.g., while the occupant is away). In one embodiment, the monitoring system 238 is configured to conserve power by operating the intruder detection system at specified intervals. In one embodiment, the transmitter 122 and receiver 124 are powered by batteries and such power conservation extends the life of the batteries. In one embodiment, the transmitter 122 operates in a pulse mode wherein the beam 126 is pulsed on and off. Operating in a pulse mode conserves power. Operating in a pulse mode also can be used to increase the signal-to-noise ratio in the intruder detection system because the receiver 124 and monitoring system 238 can recognize the pulsed beam 126 in the presence of noise (e.g., radiation from other sources).

In one embodiment, the transmitter 122 and/or the receiver 124 communicate with the monitoring system 238 by using wireless communication (e.g., infrared, radio frequency communication, etc.). In one embodiment, the transmitter 122 and/or the receiver 124 communicate with the monitoring system 238 by using unidirectional wireless communication (e.g., the transmitter receives commands from the monitoring system 238 and the receiver 124 sends received data to the monitoring system 238). In one embodiment, the transmitter 122 and/or the receiver 124 communicate with the monitoring system 238 by using bidirectional wireless communication so that the monitoring system 238 can both send commands and receive data from the transmitter 122 and the receiver 124. In one embodiment, the receiver 124 conserves power by sending data to the monitoring system 238 when queried by the monitoring system 238 or when the receiver 124 detects an interruption (e.g., a full or partial interruption) of the beam. In one embodiment, the receiver 124 collects data (e.g. counts beam interruptions) for a specified period of time and sends the beam interruption data to the monitoring system 238 at periodic intervals. In one embodiment, the receiver 124 collects data (e.g. counts beam interruptions) for a specified period of time and sends the beam interruption data to the monitoring system 238 when the interruption count exceeds a specified value and/or a specified time interval has elapsed.

In one embodiment, the foregoing beam-interrupt based detection system includes transmitter(s) and receiver(s) that are configured for beams including, but not limited to, lasers and other collimated non-laser lights. For lasers, numerous different types can be used, including by way of examples, infrared laser, helium-neon (HeNe) laser, solid state laser, laser diode, and the like.

In one embodiment, the transmitters and/or receivers are battery-powered. In one embodiment, the transmitters and/or receivers communicate with the processor 105, 162, etc. by wireless communication.

In one embodiment, the energy beam 126 is potentially hazardous to humans or the system is likely to produce false detections when humans or pets interact with the energy beam 126. Thus, in one embodiment, the intruder detection system is configured to turn the energy beam 126 off when humans or pets are likely to be in the area where the intruder detection system is operating. In one embodiment, the system is configured to produce the energy beam at night. In one embodiment, the intruder detection system includes a light sensor, and the system is configured to produce the energy beam during periods of relative darkness. In one embodiment, the system is configured to produce the energy beam during one or more specified time periods. In one embodiment, the intruder detection system includes a motion detector configured to detect motion from humans, and wherein the system is configured to produce the energy beam during periods when motion is not detected. In one embodiment, the system is configured to turn off the energy beam when motion is detected by a motion detector. In one embodiment, the receiver is configured to send data at regular intervals. In one embodiment, the receiver is configured to send data when a specified intruder detection count is exceeded. In one embodiment, the receiver is configured to send data when at least a partial interruption of the beam is detected.

In one embodiment, the receiver is configured to send data when a backscatter from the beam changes. In one embodiment, the receiver is configured to send data when interrogated by the processor.

FIGS. 9 and 10 show embodiments of an imaging-based intruder detection system. The imaging-based intruder detection system can be used alone or in combination with other detection systems, such as, for example, the beam-based system described in connection with FIGS. 1-8. In one embodiment as shown in FIG. 9, an image-based detection system 240 includes an imaging device 242, such as a camera that is positioned about a monitored area such as a room 244. The camera 242 is shown to have an angular coverage 248 that provides a field of view 246 that defines a monitored area 250. The camera 242 is functionally linked to a processor 252 that processes images obtained from the camera 242. The detection system 240 can further include a storage component 254 that can store data corresponding to raw and/or processed images.

FIG. 10 shows the system of FIG. 9 with the inclusion of a first RFID reader 241 configured to read RFID tags in the field of view of the imager 242. An optional second RFID reader 249 can also be included. The RFID readers allow the system to identify non-intruders carrying RFID tags.

In one embodiment, the imaging device 242 includes a thermal imaging device that forms an image based on the thermal emissions of objects in the field of view. Such a device can be used in dark environments where intruders are more likely to be active.

One of ordinary skill in the art will recognize that even though the imaging system of FIGS. 9-14 is described in terms of optical systems, the imaging system can be configured to use other forms of radiation, such as, for example, microwave radiation, millimeter wave radiation, acoustic wave radiation, etc.

Figure 11:
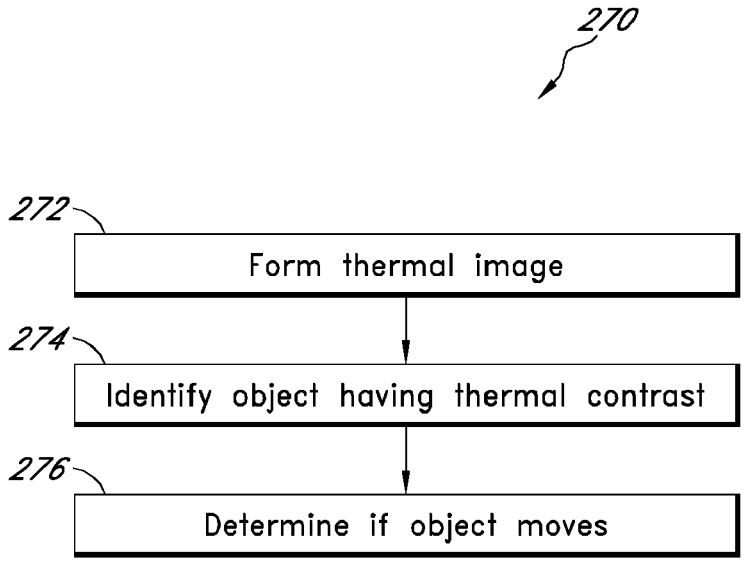
FIG. 11 shows one embodiment of a process that can be configured to identify and detect movement of intruders based on one or more thermal images.

FIG. 11 shows one embodiment of a process 270 that can distinguish and identify moving intruders in a monitored dark area. The process 270 in a process block 272 forms one or more images of the monitored dark area. In a process block 274, the process 270 identifies one or more objects relatively contrast with the background of the obtained image(s). In a process block 276, the process 270 determines whether one or more of the identified objects move or not. In one embodiment, the moving objects can be identified as intruders.

Figure 12:
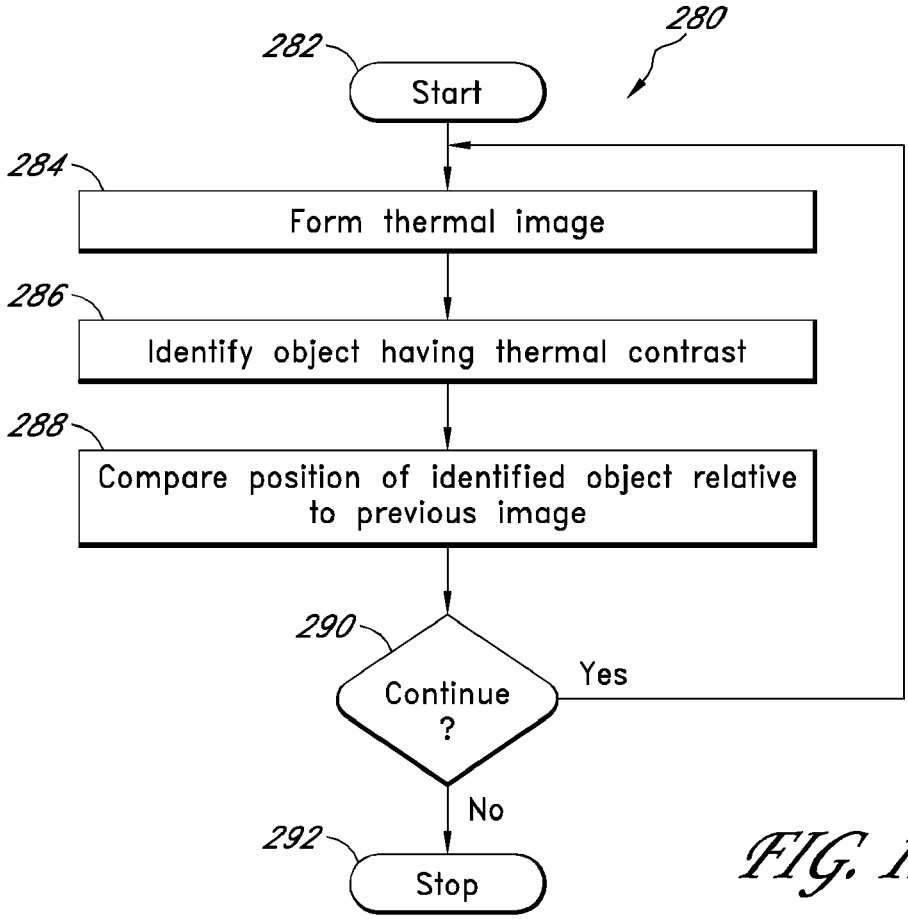
FIG. 12 shows an example process that can perform the intruder movement detection of the process of FIG. 11.

FIG. 12 shows one embodiment of a process 280 that can be an example of the process 270 described above in reference to FIG. 11. The example process 280 begins at a start state 282. The process 280 in a process block 284 forms an image (e.g., a thermal image, an IR image, a UV image, etc.) of a monitored area. In a process block 286, the process 280 identifies one or more objects having contrast (e.g., thermal contrast, IR contrast, UV contrast, etc.). In a process block 288, the process 288 compares positions of the one or more identified objects relative to those corresponding to a previous image. In one embodiment, displacements of the identified objects relative to the previous image can be interpreted as resulting from movements of the objects; thus, such objects can be identified as intruders. The process 280 in a decision block 290 determines whether monitoring should continue. If the answer is "Yes," the process 280 loops back to the process block 284 to form another thermal image. If the answer is "No," the process 280 ends at a stop state 292.

Figure 13A:
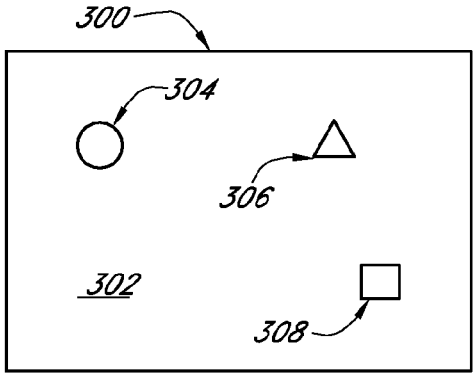
FIGS. 13A and B show by example how moving intruders can be tracked based on comparison of thermal images obtained at different times.
Figure 13B:
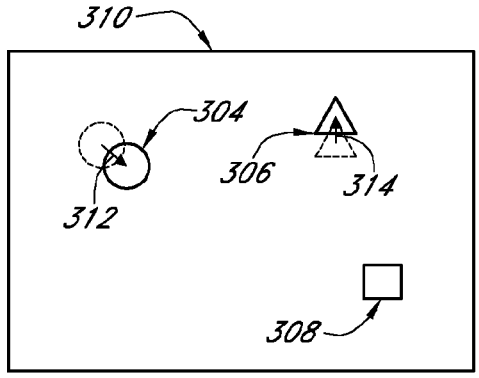

FIGS. 13A-13B show by example how movements of identified objects can be determined. Such determination of moving objects based on example images can be performed by the example process 280 described above in reference to FIG. 12. FIG. 13A shows a first example image 300 having identified objects 304, 306, and 308 that are contrasted with respect to the background of a monitored area 302.

FIG. 13B shows a second example thermal image 310 having the identified objects 304, 306, and 308. In one embodiment, the second image 310 is obtained after a predetermined period from the first image 300. The positions of the objects identified in the second image are depicted in comparison to those corresponding to the first image (objects of the previous image depicted with dotted outlines). As shown in the example second image 310, movements since the previous image are depicted as arrows 312 and 314 for the objects 304 and 306, respectively. The example object 308 is shown to have not moved since the first image 300.

Figure 14A:
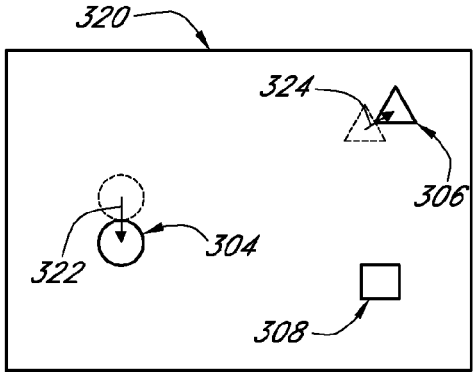
FIGS. 14A and B show additional examples of how moving intruders can be tracked based on comparison of thermal images obtained at different times.
Figure 14B:
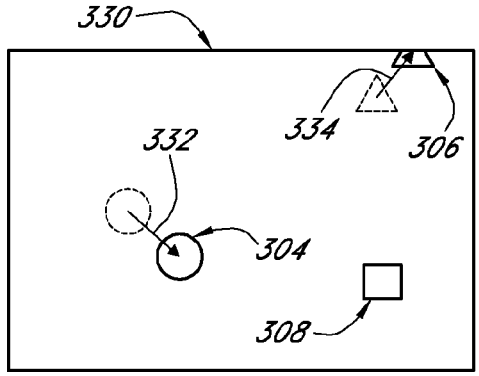

FIGS. 14A and 14B show third and fourth example images 320 and 330. In one embodiment, such images are obtained after the predetermined periods similar to that between the first and second images. The third and fourth images further show movements of the two example objects 304 and 306 as arrows 322, 332 (for the object 304) and arrows 324, 334 (for the object 306). The example object 308 is shown to have not moved in the example third and fourth images 320 and 330.

Figure 15:
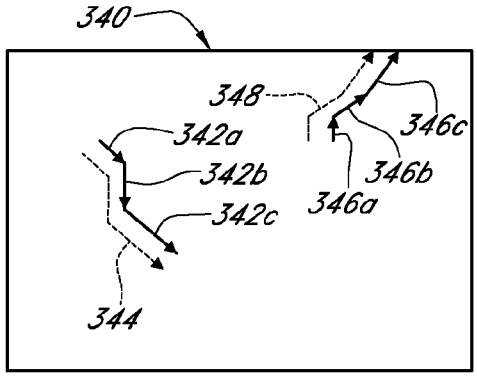
FIG. 15 shows by example how the example movements of FIGS. 13A-B and 14A-B can be presented in a summarized manner.

In one embodiment, information corresponding to movements of the identified thermal objects (in the example of FIGS. 13A-13B and 14A-14B, the arrows 312, 322, 332 for the object 304, and the arrows 314, 324, 334 for the object 306) can be represented in a summarized manner as shown in an example representation 340 in FIG. 15. In the example representation 340, image-by-image movement of the example object 304 is depicted as displacement segments 342*a*, 342*b*, and 342*c*. Similarly, image-by-image movement of the example object 306 is depicted as displacement segments 346*a*, 346*b*, and 346*c*. In one embodiment, a series of joined displacement segments can be manipulated by a number of ways (spline technique, for example) to yield a smoothed representation of the segments. Thus, the series of displacement segments 342 can be manipulated to form a smoothed representation 344. Similarly, the series of displacement segments 346 can be manipulated to form a smoothed representation 348.

Based on the foregoing description in reference to FIGS. 9-15, one can see that various embodiments of the imaging-based detection system allows detection of intruders based on their movements in environments that are comfortable for them. As is known, intruders generally prefer to operate in darkness when a human being either is not present and/or cannot see them. Thus, identifying moving objects in darkness, such as via thermal imaging, UV imaging, IR imaging, and the like, allows identification of intruders based on their sizes and/or their image signatures. By detecting a parameter (motion in one embodiment) that is indicative of an intruder, a monitoring system can selectively monitor a given area. For example, a monitoring system can begin recording thermal images after a motion of a qualifying thermal object is detected. Such recording can then pause or stop when no more motion is detected. One can see that such selective recording can improve the efficiency in the recording of the monitored information, as well as reviewing of such information.

Figure 16:
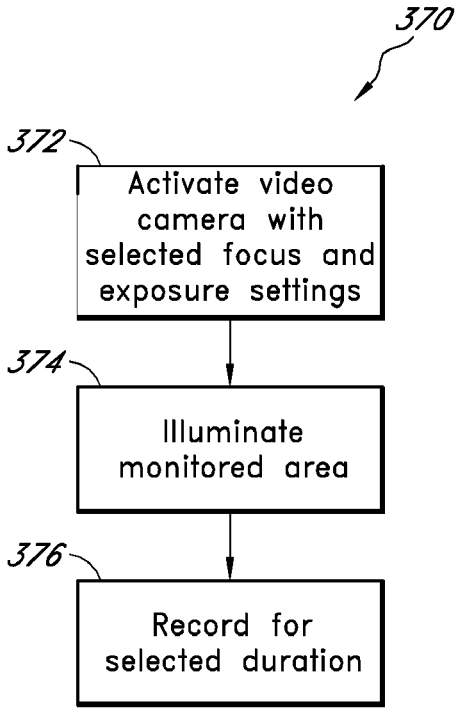
FIG. 16 shows a first specific example process for detection.
Figure 17:
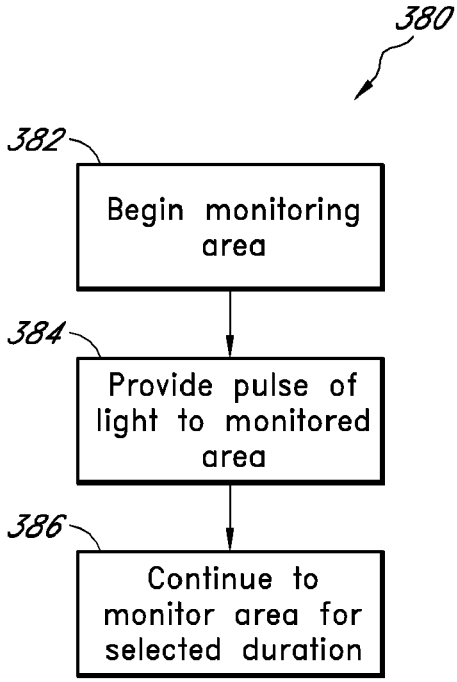
FIG. 17 shows a second specific example process for detection.

FIGS. 16 and 17 show two example processes for detection. As shown in FIG. 16, an example process 370 in a process block 372 activates and prepares a digital video camera or digital still camera 242. In one embodiment, the camera 242 is configured with a selected pre-focus and a predetermined exposure setting to allow proper recording of images substantially immediately after sudden introduction of light when the intruders are likely to move quickly. In one embodiment the processor 252 is configured to control one or more of a focus setting, an exposure setting, a zoom setting, and/or a pan setting. In one embodiment, the processor 252 can control zoom and pan of the camera 242 to change the field of view 250. The process 370 in a process block 374 illuminates the monitored area. In a process block 376, the process 370 records the images of the monitored area for a selected duration.

The example process 370 shows that selectively recording the monitored area during the period of likely intruder movement can improve the efficiency in which possible intruder detection and source location can be ascertained. Recording after introduction of light can visually indicate presence of intruders, if any. Movements of such intruders to their hiding locations can also be recorded and reviewed visually.

As shown in FIG. 17, an example process 380 in a process block 382 begins monitoring of an area. In a process block 384, the process 380 provides a motion-inducing stimulus such as a light pulse to the monitored area. The process 380 in a process block 386 continues to monitor area for a selected duration.

Figure 18:
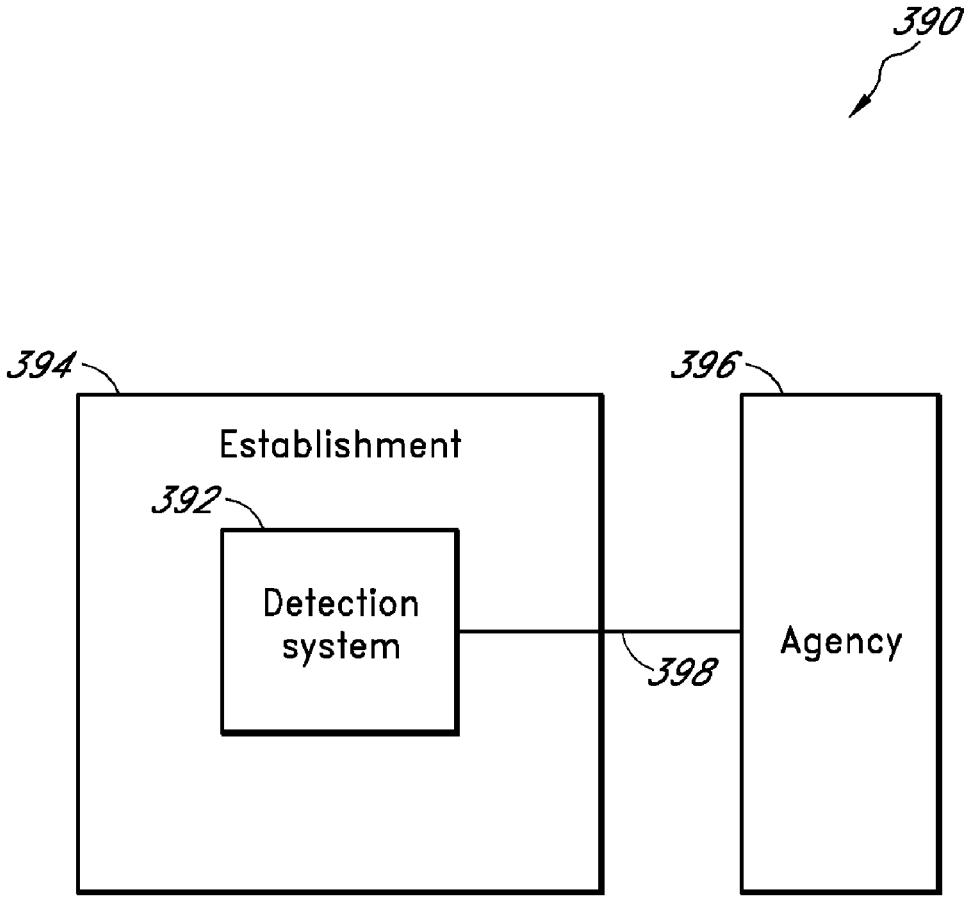
FIG. 18 shows one embodiment of an intruder monitoring system that is provided to an external agency so as to allow external monitoring of an establishment.

One or some combination of the various embodiments of the intruder detection system described above can be linked to a security service such as a private security service, police, etc. FIG. 18 shows a block diagram of one embodiment of a remote monitoring system 390, where an establishment 394 is monitored by an intruder detection system 392. The intruder detection system 392 can include any or some combination of the various techniques described above.

In one embodiment as shown in FIG. 18, the intruder detection system 392 can be linked to a monitoring agency 396 via a link 398. In one embodiment, the link 398 provides a communication link between the intruder detection system 392 and the agency 396. Such a link can allow transmission of information obtained by the intruder detection system 392 from its monitoring of the establishment. Such information can include, by way of example, actual relevant recordings of the monitored intruders whether in a raw form or some summarized form.

In one embodiment, the system is configured to detect intruders at night. In one embodiment, the intruder detection system includes a light sensor, and the system is configured to detect intruders during periods of relative darkness. In one embodiment, the system is configured to detect intruders during one or more specified time periods. In one embodiment, the intruder detection system includes a motion detector configured to detect motion from non-intruders, and the system is configured to detect intruders during periods when non-intruder motion is not detected by the motion detector. In one embodiment, the system is configured to suspend intruder detection when a room light turns on. In one embodiment, the system is configured to suspend intruder detection when the motion detected by the motion detector corresponds to motion of a non-intruder.

In one embodiment, the detection system provides a plurality of selectable alarm and/or warning modes. In one alarm/warning mode, the system sounds an alarm/warning when an intruder is detected.

In one embodiment, the system sounds an alarm/warning when one or more adults are detected in an area (e.g., the area monitored by the camera 120, the area monitored by the system 140, etc.) even if some, but not all, of the adults are identified as non-intruders. Thus, for example, if an intruder is present in the same area as a non-intruder, an alert/alarm is still provided.

In a traditional intruder alarm system such as, for example, a burglar alarm system, motion detectors (and possibly other detectors) are disabled when occupants are present. Since the system described herein provide for identification of intruders and non-intruders, the system need not be disabled when occupants are present. The system identifies non-intruders and thus does not sound false alarms when non-intruders are detected. Thus, the occupants are relieved of the burden of enabling and disabling the intruder detection system. Moreover, since the system described herein can monitor various areas of a building or dwelling, and distinguish between intruders and non-intruders, the system can sound an alarm/warning when an intruder is detected in another area of the building (e.g., an intruder in a basement, an intruder in a downstairs area during the night, etc.) and warn the occupants of the intrusion.

In one embodiment the system is configured such that alarm and/or warnings can be disabled for a specified period of time, after which the system will automatically re-activate. Thus, for example, if guests arrive, the occupant can instruct the system to disable for a period of time (e.g., one hour, two hours, four hours, etc.).

In one embodiment the system is configured such that certain alarm and/or warning modes are disabled during specified times of day. Thus, for example, the system can be configured such that during afternoon and early evening hours, the system does not give a warning or alarm if an intruder (e.g., an unrecognized adult) is in the same area (or specified areas) as a non-intruder. For example, in one mode, the system will not warn when an unrecognized adult is in the same area as a recognized adult. As a further example, in one mode, the system will not warn when an unrecognized adult is in certain specified areas (e.g., the living room, dining room, etc.) but will warn if an unrecognized adult (an intruder) is in other specified areas (e.g., a basement, a bedroom, etc.) As a further example, in one mode, the system will not warn when an unrecognized adult is in certain specified areas (e.g., the living room, dining room, etc.) but will warn if an unrecognized adult (an intruder) is in other specified areas (e.g., a basement, a bedroom, etc.) and not accompanied by a recognized adult.

In one embodiment, a user can program the system to operate in different alarm/warning modes depending on the time of day, the day of the week, etc.

Although the above-disclosed embodiments have shown, described, and pointed out the fundamental novel features of the invention as applied to the above-disclosed embodiments, it should be understood that various omissions, substitutions, and changes in the form of the detail of the devices, systems, and/or methods shown can be made by those skilled in the art without departing from the scope of the invention. Consequently, the scope of the invention should not be limited to the foregoing description, but should be defined by the appended claims.

What is claimed is:

1. A system for detecting intruders, comprising:

a transmitter configured to produce an energy beam;

a first receiver configured to detect energy from said beam; and a processor provided to said first receiver, said processor configured to detect a presence of an intruder by determining when said energy beam is at least partially interrupted, said processor further configured to distinguish between intruders and non-intruders by communicating with an RFID tag carried by non-intruders, wherein said first receiver is configured to receive backscattered energy from said beam when said beam illuminates an intruder.

2. A system for detecting intruders, comprising:

a first transmitter configured to produce an energy beam;

a first receiver configured to detect energy from said beam; and a processor provided to said first receiver, said processor configured to detect a presence of an intruder by determining when said energy beam is at least partially interrupted, said processor further configured to distinguish between intruders and non-intruders by communicating with an RFID tag carried by non-intruders, wherein said first receiver is configured to receive bistatic backscattered energy from said beam when said beam illuminates an intruder.

3. The system of claim 2, wherein said first receiver is battery-powered.

4. The system of claim 2 wherein said first transmitter is battery-powered.

5. The system of claim 2, wherein said processor is configured to control said first transmitter.

6. The system of claim 2, wherein said processor is configured to control said first transmitter by using wireless communication.

7. The system of claim 2, wherein said processor is configured to receive data from said first receiver by using wireless communication.

8. The system of claim 2, wherein said first receiver is provided at a first height, said system further comprising a second receiver provided at a second height.

9. The system of claim 2, wherein said first transmitter comprises a laser.

10. The system of claim 2, wherein said first transmitter produces said energy beam as a substantially continuous beam.

11. The system of claim 2, wherein said system is configured to produce said energy beam at night.

12. A system for detecting intruders, comprising:

a transmitter configured to produce an energy beam;

a first receiver configured to detect energy from said beam; and a processor provided to said first receiver, said processor configured to detect a presence of an intruder by determining when said energy beam is at least partially interrupted, said processor further configured to distinguish between intruders and non-intruders by communicating with an RFID tag carried by non-intruders, further comprising a light sensor, and wherein said system is configured to produce said energy beam during periods of relative darkness.

13. A system for detecting intruders, comprising:

a transmitter configured to produce an energy beam;

a first receiver configured to detect energy from said beam; and a processor provided to said first receiver, said processor configured to detect a presence of an intruder by determining when said energy beam is at least partially interrupted, said processor further configured to distinguish between intruders and non-intruders by communicating with an RFID tag carried by non-intruders, wherein said system is configured to produce said energy beam during one or more specified time periods.

14. A system for detecting intruders, comprising:

a transmitter configured to produce an energy beam;

a first receiver configured to detect energy from said beam; and a processor provided to said first receiver, said processor configured to detect a presence of an intruder by determining when said energy beam is at least partially interrupted, said processor further configured to distinguish between intruders and non-intruders by communicating with an RFID tag carried by non-intruders, further comprising a motion detector configured to detect motion from humans, and wherein said system is configured to produce said energy beam during periods when motion is not detected by the motion detector.

15. A system for detecting intruders, comprising:

a transmitter configured to produce an energy beam;

a first receiver configured to detect energy from said beam; and a processor provided to said first receiver, said processor configured to detect a presence of an intruder by determining when said energy beam is at least partially interrupted, said processor further configured to distinguish between intruders and non-intruders by communicating with an RFID tag carried by non-intruders, wherein said system is configured to turn off said energy beam when a room light turns on.

16. A system for detecting intruders, comprising:

a transmitter configured to produce an energy beam;

a first receiver configured to detect energy from said beam; and a processor provided to said first receiver, said processor configured to detect a presence of an intruder by determining when said energy beam is at least partially interrupted, said processor further configured to distinguish between intruders and non-intruders by communicating with an RFID tag carried by non-intruders, wherein said system is configured to turn off said energy beam when motion is detected by a motion detector.

17. A system for detecting intruders, comprising:

a transmitter configured to produce an energy beam;

a first receiver configured to detect energy from said beam; and a processor provided to said first receiver, said processor configured to detect a presence of an intruder by determining when said energy beam is at least partially interrupted, said processor further configured to distinguish between intruders and non-intruders by communicating with an RFID tag carried by non-intruders, wherein said first receiver is configured to send data to said processor at regular intervals.

18. A system for detecting intruders, comprising:

a transmitter configured to produce an energy beam;

a first receiver configured to detect energy from said beam; and a processor provided to said first receiver, said processor configured to detect a presence of an intruder by determining when said energy beam is at least partially interrupted, said processor further configured to distinguish between intruders and non-intruders by communicating with an RFID tag carried by non-intruders, wherein said first receiver is configured to send data to said processor when a specified intruder detection count is exceeded.

19. The system of claim 18, wherein said first receiver is configured to send data to said processor when at least a partial interruption of said beam is detected.

20. A system for detecting intruders, comprising:

a transmitter configured to produce an energy beam;

a first receiver configured to detect energy from said beam; and a processor provided to said first receiver, said processor configured to detect a presence of an intruder by determining when said energy beam is at least partially interrupted, said processor further configured to distinguish between intruders and non-intruders by communicating with an RFID tag carried by non-intruders, wherein said first receiver is configured to send data to said processor when a backscatter from said beam changes.

21. A system for detecting intruders, comprising:

a transmitter configured to produce an energy beam;

a first receiver configured to detect energy from said beam; and a processor provided to said first receiver, said processor configured to detect a presence of an intruder by determining when said energy beam is at least partially interrupted, said processor further configured to distinguish between intruders and non-intruders by communicating with an RFID tag carried by non-intruders, wherein said first receiver is configured to send data to said processor when interrogated by said processor.

22. A system for detecting intruders, comprising:

a camera configured to produce first and second digital images;

an RFID reader configured to read RFID tags within a field of view of said camera; and a processor provided to said camera, said processor configured to examine said first and second digital images to detect a movement of one or more intruders by determining movement of an intruder-sized object in said first and second images, said processor further configured to distinguish between intruders and non-intruders by using said RFID reader to read an RFID tag carried by non-intruders.

23. The system of claim 22, further comprising an illumination source configured to at least partially illuminate a field of view of said camera.

24. The system of claim 23, wherein said illumination source comprises an infrared source.

25. The system of claim 23, wherein said illumination source comprises an ultraviolet source.

26. The system of claim 22, wherein said camera comprises a zoom feature controlled by said processor.

27. The system of claim 22, wherein said camera comprises a pan feature controlled by said processor.

28. The system of claim 22, wherein said processor is configured to control said camera by using wireless communication.

29. The system of claim 22, wherein said processor is configured to count said one or more intruders.

30. The system of claim 22, wherein said processor is configured to identify said one or more intruders at least in part by measuring a size of said intruder in said first image.

31. The system of claim 24, wherein said processor is configured to identify said one or more intruders at least in part by measuring a size and movement track of said intruder in said first and second images.

32. The system of claim 22, wherein said processor is configured to distinguish between intruders and non-intruders at least in part by measuring a size of a moving object in said first and second image.

33. The system of claim 22, wherein said system is configured to operate at night.

34. The system of claim 22, further comprising a light sensor, and wherein said system is configured to operate during periods of relative darkness.

35. The system of claim 22, wherein said system is configured to operate during one or more specified time periods.

36. The system of claim 22, further comprising a motion detector configured to detect motion from humans, and wherein said system is configured to operate during periods when motion is detected.

37. The system of claim 22, wherein said system is configured to suspend intruder detection when a room light turns on.

38. The system of claim 22, wherein said system is configured to suspend intruder detection when said RFID reader detects a valid RFID tag within a field of view of the RFID reader.

39. The system of claim 22, wherein said camera is configured to send data at regular intervals.

40. The system of claim 22, wherein said camera is configured to send data when a specified intruder detection count is exceeded.

41. The system of claim 22, wherein said camera is configured to send data when at least a partial interruption of a beam is detected.

42. The system of claim 22, wherein said camera is configured to send data when a backscatter from a beam changes.

43. The system of claim 22, wherein said camera is configured to send data when interrogated by said processor.

44. The system of claim 22, wherein said camera is configured to produce an image from infrared light corresponding to thermal sources.

* * * * *

UNITED STATES PATENT AND TRADEMARK OFFICE

CERTIFICATE OF CORRECTION

PATENT NO. : 7,411,497 B2
APPLICATION NO. : 11/464731
DATED : August 12, 2008
INVENTOR(S) : Lawrence Kates It is certified that error appears in the above-identified patent and that said Letters Patent is hereby corrected as shown below:

In column 18 at line 13, In Claim 13, change "24," to --22,--.

Signed and Sealed this

Tenth Day of November, 2009

David J. Kappos

David J. Kappos
*Director of the United States Patent and Trademark Office*